US010119516B2

(12) United States Patent
Andersson et al.

(10) Patent No.: US 10,119,516 B2
(45) Date of Patent: Nov. 6, 2018

(54) IGNITION DIAGNOSTICS SYSTEM

(71) Applicant: WALBRO ENGINE MANAGEMENT, L.L.C., Tucson, AZ (US)

(72) Inventors: Martin N. Andersson, Caro, MI (US); Cyrus M. Healy, Ubly, MI (US); Russell R. Speirs, Cass City, MI (US)

(73) Assignee: Walbro, LLC, Tucson, AZ (US)

( * ) Notice: Subject to any disclaimer, the term of this patent is extended or adjusted under 35 U.S.C. 154(b) by 104 days.

(21) Appl. No.: 14/768,592

(22) PCT Filed: Mar. 12, 2014

(86) PCT No.: PCT/US2014/024103
§ 371 (c)(1),
(2) Date: Aug. 18, 2015

(87) PCT Pub. No.: WO2014/150742
PCT Pub. Date: Sep. 25, 2014

(65) Prior Publication Data

US 2016/0003210 A1 Jan. 7, 2016

Related U.S. Application Data

(60) Provisional application No. 61/790,419, filed on Mar. 15, 2013.

(51) Int. Cl.
*F02P 9/00* (2006.01)
*F02P 3/08* (2006.01)
(Continued)

(52) U.S. Cl.
CPC ..... *F02P 9/002* (2013.01); *F02P 3/0807* (2013.01); *F02P 7/03* (2013.01); *F02P 7/063* (2013.01);
(Continued)

(58) Field of Classification Search
CPC .. F02P 9/002; F02P 3/0807; F02P 3/02; F02P 3/0453; F02P 7/03; F02P 7/063;
(Continued)

(56) References Cited

U.S. PATENT DOCUMENTS 4,324,215 A * 4/1982 Sieja ..... F02P 9/005 123/350
5,769,051 A 6/1998 Bayron et al.
(Continued)

FOREIGN PATENT DOCUMENTS

EP 1643120 A2 4/2006

OTHER PUBLICATIONS

Written Opinion & International Search Report for PCT/US2014/024103 dated Jul. 8, 2014, 11 pages.

*Primary Examiner* — Hai Huynh
*Assistant Examiner* — Gonzalo Laguarda
(74) *Attorney, Agent, or Firm* — Reising Ethington PC

(57) ABSTRACT

A spark ignition engine system for communicating data includes a capacitive discharge ignition system using a microcontroller for controlling the spark ignition of a light-duty internal combustion engine; a memory device communicated with the microcontroller, wherein the micro-controller obtains engine data from the light-duty internal combustion engine and stores the engine data or software using the memory device; and a powering connection and a separate data connection that are electrically connected to different pins of the microcontroller, wherein the powering connection supplies power to the microcontroller while engine data or software is communicated via the data connection.

12 Claims, 4 Drawing Sheets

(51) Int. Cl.
*F02P 17/00* (2006.01)
*F02P 7/03* (2006.01)
*F02P 7/063* (2006.01)

(52) U.S. Cl.
CPC ..... *F02P 17/00* (2013.01); *F02D 2400/06* (2013.01); *F02D 2400/21* (2013.01); *F02D 2400/22* (2013.01)

(58) Field of Classification Search
CPC .... F02P 17/00; F02P 5/15; F02P 5/145; F02P 13/00; F02P 15/001; F02P 11/02; F02P 11/025; F02D 2400/21; F02D 2400/22; F02D 2400/06; H01F 38/12
USPC ..... 123/406.12
See application file for complete search history.

(56) References Cited

U.S. PATENT DOCUMENTS

| | | | | |
|---|---|---|---|---|
| 6,390,205 | B2 * | 5/2002 | Wallgren | B25B 21/00 173/171 |
| 7,448,358 | B2 | 11/2008 | Andersson et al. | |
| 7,546,836 | B2 | 6/2009 | Andersson et al. | |
| 7,596,436 | B2 | 9/2009 | Falter et al. | |
| 8,482,289 | B2 * | 7/2013 | Boker | F02D 41/22 324/511 |
| 2002/0013654 | A1 | 1/2002 | Masters et al. | |
| 2008/0041146 | A1 * | 2/2008 | Leufen | F02D 41/24 73/116.02 |
| 2010/0319956 | A1 * | 12/2010 | Ballard | B60R 16/0207 174/105 R |
| 2014/0137846 | A1 * | 5/2014 | Lenz | F02P 1/086 123/644 |

* cited by examiner

IGNITION DIAGNOSTICS SYSTEM

REFERENCE TO CO-PENDING APPLICATION

This application claims the benefit of U.S. Provisional Application No. 61/790,419 filed Mar. 15, 2013, which is incorporated herein by reference in its entirety.

TECHNICAL FIELD

The present disclosure relates generally to internal combustion engines and more particularly to light-duty engine diagnostic systems.

BACKGROUND

Various electronic ignition timing control systems for light-duty engines that power a wide range of devices, such as lawn equipment, chainsaws, and the like are known in the art. Typically, these ignition systems do not have any battery and these engines are manually started with a pull-rope recoil starter. There is a need to obtain data on the operation of these engines for diagnostic purposes and to program electronic control systems of these engines.

SUMMARY

According to one aspect of the disclosure, a spark ignition engine system for communicating data includes a capacitive discharge ignition system using a microcontroller for controlling the spark ignition of a light-duty internal combustion engine; a memory device communicated with the microcontroller, wherein the microcontroller obtains engine data from the light-duty internal combustion engine and stores the engine data or software using the memory device; and a powering connection and a separate data connection that are electrically connected to different pins of the microcontroller, wherein the powering connection supplies power to the microcontroller while engine data or software is communicated via the data connection.

According to another aspect of the disclosure, a spark ignition engine system for communicating data includes a capacitive discharge ignition system using a microcontroller for controlling the ignition of a light-duty internal combustion engine; a memory device communicated with the microcontroller, wherein the microcontroller obtains engine data from the light-duty internal combustion engine and stores the engine data or software using the memory device; a data connection coupled with the microcontroller; a separate powering connection coupled with the microcontroller for powering the microcontroller while engine data or software is communicated via the data connection; and an intermediary computing device that is detachably coupled to the data connection and the powering connection while engine data or software is communicated via the data connection.

According to yet another aspect of the disclosure, a spark ignition engine system for communicating data includes a capacitive discharge ignition system using a microcontroller for controlling the ignition of a light-duty internal combustion engine; a memory device communicated with the microcontroller, wherein the microcontroller obtains engine data from the light-duty internal combustion engine and stores the engine data or software using the memory device; and a kill switch that is removably-carried by a cover of the light-duty internal combustion engine, wherein the kill switch is in communication with a data connection electrically linked to the microcontroller and with a separate powering connection electrically linked to the microcontroller, and when the kill switch is removed and disconnected from the data connection and the powering connection, an intermediary computing device is connected to the data connection for communicating data with the microcontroller and the powering connection for providing power.

BRIEF DESCRIPTION OF THE DRAWINGS

The following detailed description of exemplary embodiments of this diagnostic system and test mode will be set forth with reference to the accompanying drawings in which.

DETAILED DESCRIPTION OF PREFERRED EMBODIMENTS

Figure 1:
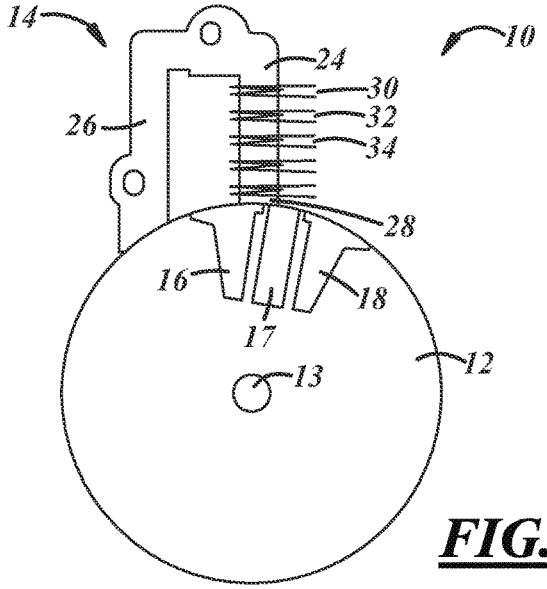
FIG. 1 shows a capacitor discharge ignition (CDI) system generally having a stator assembly mounted adjacent a rotating flywheel.

The methods and systems described herein generally relate to a light-duty gasoline powered spark plug ignited internal combustion engine that includes microcontroller circuitry, which can record and store engine operating data. The stored data can be communicated to an external digital computer such as a personal computer (PC) through an intermediary computing device. The intermediary computing device may also permit the computer to be used to re-program or re-flash the memory of the microcontroller. The engine preferably has a so-called kill switch mounted on a cowl, cover, or housing of the engine that is accessible from the exterior of the engine housing and may be manually actuated by an operator to stop or terminate operation of the running engine. Desirably, the kill switch can be removed from the engine housing and disconnected from terminals at least some of which can then be connected to the intermediary computing device to supply electrical energy to power up the microcontroller and communicate data from the microcontroller to the external computer or from the computer to the microcontroller for re-programming or re-flashing the memory of the microcontroller. After the data communication is completed, the intermediary computing device may be unplugged or disconnected from the terminals and the kill switch reconnected to them and attached to the housing for continued use in stopping or terminating operation of the running engine.

Typically the light duty engine is a single cylinder two-cycle or four-cycle gasoline powered internal combustion engine. A single piston is slidably received for reciprocation in the cylinder and connected by a tie rod to a crank shaft attached to a fly wheel and typically having a capacitive discharge ignition "CDI" system for supplying a high voltage ignition pulse to a spark plug for igniting an air-fuel mixture in the engine combustion chamber. These engines do not have a separate battery for supplying an electric current to the spark plug and powering the engine electronic ignition control circuitry and micro-processor. Typically these engines are manually cranked for starting with an automatic recoil rope starter.

The term "light-duty combustion engine" broadly includes all types of non-automotive combustion engines, including two- and four-stroke engines typically used to power various devices, such as internal-combustion gasoline-powered hand-held power tools, lawn and garden equipment, lawnmowers, weed trimmers, edgers, chain saws, snowblowers, personal watercraft, boats, snowmobiles, motorcycles, all-terrain-vehicles, etc. The system and method can record data relating to one or more operating characteristics of a light-duty engine. This data can be obtained using firmware stored on a microcontroller that also controls the engine system. That way, if a light-duty engine is returned to the manufacturer (or other facility, such as a repair shop) after it was sold to its end user, technicians can access the data and try to determine how the engine has been used or what, if anything, went wrong. In one implementation, the data can be obtained from the light-duty engine via a kill switch terminal that includes a powering connection and a data connection that are in communication with the microcontroller of the device and communicated to an external computer.

This system and method can aid the manufacturer with diagnosing problem(s) that may exist with respect to the engine. For instance, retailers can sell devices having light-duty engines to consumers and often include a warranty that may be serviced by a manufacturer of the device. When a customer returns a device to the retailer, the underlying reason for the return may not always be apparent to the manufacturer of the device. For instance, the manufacturer may initially inspect the engine of the device and find no defect. And it may be possible that a customer may have wrongly determined that the engine does not operate correctly or simply not been entirely forthcoming about the actual use of the device. Therefore, when a technician later operates the returned device it may appear to operate normally or in a manner inconsistent with the description offered by the customer/operator.

In another example, light-duty engines may be used with devices in commercial settings and fail at the end of their service life. Determining the failure point of the light-duty engines used thusly can be valuable to determine service life of light-duty engines and/or yield data that can be used to improve the design and service life of such engines in the future. A thorough unit-by-unit investigation of possible engine failures may be time consuming and unreasonable given the volume of devices that are manufactured. The engine data can reflect the performance of the engine and/or device when it was used in its operating environment. It can then be accessed by a manufacturer or repair facility.

As will be explained in greater detail, light-duty engines can use a capacitive discharge ignition (CDI) system 10—an example of which is shown in FIG. 1—that includes one of a number of control circuits, including the exemplary embodiment described in relation to FIG. 2. The CDI system 10 generally includes a flywheel 12 rotatably mounted on an engine crankshaft 13, a stator assembly 14 mounted adjacent the flywheel, and a control circuit (not shown in FIG. 1). Flywheel 12 rotates with the engine crankshaft 13 and generally includes a permanent magnetic element having pole shoes 16, 18, and a permanent magnet 17, such that it induces a magnetic flux in the nearby stator assembly 14 as the magnets pass thereby.

Stator assembly 14 may be separated from the rotating flywheel 12 by a measured air gap (e.g. the air gap may be 0.3 mm), and may include a lamination stack 24 having first and second legs 26, 28, a charge coil winding 30 and an ignition coil comprising a primary winding 32 and a secondary ignition winding 34. The lamination stack 24 may be a generally U-shaped ferrous armature made from a stack of iron plates, and may be mounted to a housing (not shown) located on the engine. Preferably, the charge winding 30 and primary and secondary ignition windings 32, 34 are all wrapped around a single leg of the lamination stack 24. Such an arrangement may result in a cost savings due to the use of a common ground and a single spool or bobbin for all of the windings. The ignition coil may be a step-up transformer having both the primary and secondary ignition windings 32, 34 wound around the second leg 28 of the lamination stack 24. Primary ignition winding 32 is coupled to the control circuit, as will be explained, and the secondary ignition winding 34 is coupled to a spark plug 42 (shown in FIG. 2) of the engine. As is appreciated by those skilled in the art, primary ignition winding 32 may have comparatively few turns of relatively heavy wire, while secondary ignition winding 34 may have many turns of relatively fine wire. The ratio of turns between the primary and secondary ignition windings 32, 34 generates a high voltage potential in the secondary winding 34 that is used to fire spark plug 42 or provide an electric arc and consequently ignite an air/fuel mixture in the engine combustion chamber.

The control circuit is coupled to stator assembly 14 and spark plug 42 and generally controls the energy that is induced, stored and discharged by the CDI system 10. The term "coupled" broadly encompasses all ways in which two or more electrical components, devices, circuits, etc. can be in electrical communication with one another; this includes but is certainly not limited to, a direct electrical connection and a connection via an intermediate component, device, circuit, etc. The control circuit can be provided according to one of a number of embodiments, including the exemplary embodiment shown in FIG. 2.

Figure 2:
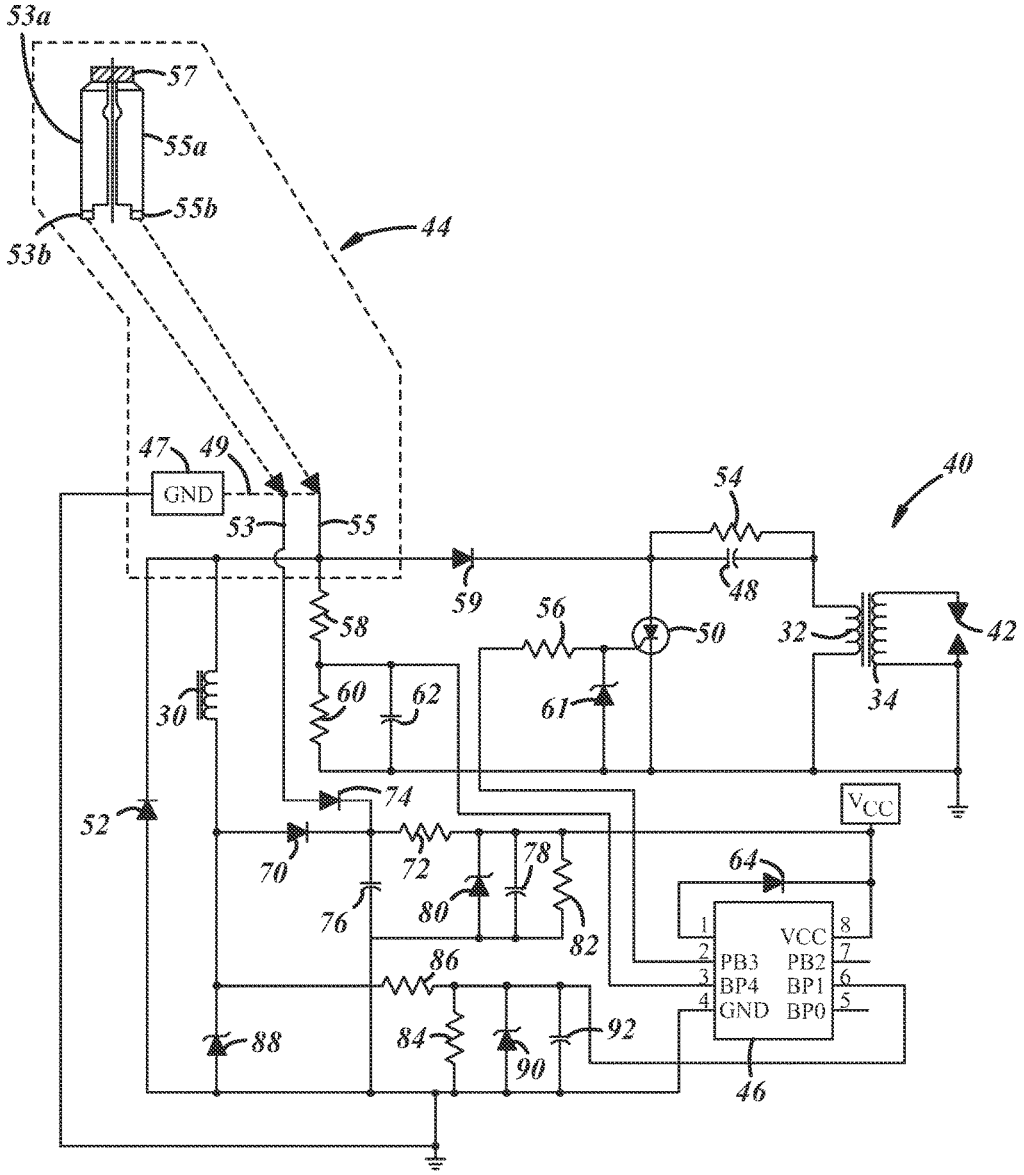
FIG. 2 is a schematic diagram of an embodiment of a control circuit that can be used with the CDI system of FIG. 1.

Referring now to FIG. 2, the CDI system 10 includes circuit 40 as an example of the type of control circuit that may be used to implement the ignition timing systems described herein. However, many variations of this circuit may alternatively be used without departing from the scope of the invention. Circuit 40 interacts with charge winding 30, primary ignition winding 32, and a kill switch terminal 44, and generally comprises a microcontroller 46, an ignition discharge capacitor 48, and an ignition switch 50. The majority of the energy induced in charge winding 30 is dumped onto ignition discharge capacitor 48, which stores the induced energy until the microcontroller 46 permits it to discharge. According to an embodiment shown here, a positive terminal of charge coil 30 is coupled to a diode 52 and a diode 59, which in turn is coupled to ignition discharge capacitor 48. A resistor 54 may be coupled in parallel to the charge ignition discharge capacitor 48.

During operation, rotation of flywheel 12 causes the magnetic elements, such as pole shoes 16, 18, to induce voltages in various coils arranged around the lamination stack 24. One of those coils is charge winding 30, which charges ignition discharge capacitor 48 through diode 59. A trigger signal from the microcontroller 46 activates switch 50 so that the ignition discharge capacitor 48 can discharge and thereby create a corresponding ignition pulse in the ignition coil. In one example, the ignition switch 50 can be a thyristor, such as a silicon controller rectifier (SCR). When the ignition switch 50 is turned 'on' (in this case, becomes conductive), the switch 50 provides a discharge path for the energy stored on ignition discharge capacitor 48. This rapid discharge of the ignition discharge capacitor 48 causes a surge in current through the primary ignition winding 32 of the ignition coil, which in turn creates a fast-rising electromagnetic field in the ignition coil. The fast-rising electromagnetic field induces a high voltage ignition pulse in secondary ignition winding 34. The high-voltage ignition pulse travels to spark plug 42 which, assuming it has the requisite voltage, provides a combustion-initiating spark. Other sparking techniques, including flyback techniques, may be used instead.

The microcontroller 46, as shown in FIG. 2, can store code for the ignition timing systems described herein. In addition, the microcontroller 46 can also store code for implementing the system and method described herein and/or storing the engine data obtained by the method. Various microcontrollers or microprocessors may be used, as is known to those skilled in the art. Examples of how microcontrollers can be implemented with ignition timing systems can be found in U.S. Pat. Nos. 7,546,836 and 7,448,358 which are incorporated by reference.

For instance, the microcontroller 46 may include a reprogrammable EEPROM that uses flash memory. The microcontroller 46 shown in FIG. 2 includes 8 pins. Pin 8 of the microcontroller 46 can be coupled through a diode 74 to a voltage source which supplies the microcontroller 46 with power. This will be discussed below in more detail. The circuit 40 depicts capacitors 76 and 78, a zener diode 80, and a resistor 82 electrically connected in circuit to pin 8 as well. In this example, pin 1 is a reset pin that is coupled to the voltage source via a diode 64. Pin 2 is coupled to the gate of ignition switch 50 via resistor 56, which is wired in circuit with zener diode 61, and transmits from the microcontroller 46 an ignition signal which controls the state of the switch 50. When the ignition signal on pin 2 is low, the ignition switch 50 is nonconductive and capacitor 48 is allowed to charge. When the ignition signal is high, the ignition switch 50 is conductive and ignition discharge capacitor 48 discharges through primary ignition winding 32, thus causing a high-voltage ignition pulse to be induced in secondary ignition winding 34 and sent to the spark plug 42. Thus, the microcontroller 46 can govern the discharge of capacitor 48 by controlling the conductive state of the switch 50. Pin 6 is coupled to the charge winding 30 via resistors 84 and 86, zener diodes 88 and 90, and capacitor 92. Pin 6 receives an electronic signal representative of the position of an engine piston in its combustion chamber usually relative to the top dead center (TDC) location of the piston. This signal can be referred to as a timing signal. The microcontroller 46 can use the timing signal to determine engine speed, the timing of an ignition pulse relative to the piston(s), TDC position (usually from a look-up table), and whether or not and, if so, when to activate an ignition pulse. Pin 3 handles data communication input/output and kill sensing. The piston position signal can also be referred to as a positive pulse. Pin 3 is coupled to the kill switch terminal 44 via resistors 58 and 60 and, capacitor 62.

Kill switch terminal 44 acts as a manual override for shutting down the engine. The kill switch terminal 44 can include a powering connection 53 and a data connection 55 that each electrically communicate with the microcontroller 46 and are accessible for sending/receiving data to/from the microcontroller 46. As used herein, the kill switch terminal 44 may be used to collectively refer to a number of elements that are included within the dashed line shown on FIG. 2. The term "electrically communicates" can mean the communication of data and/or electrical signals (e.g. voltage or current). The powering connection 53 can be electrically connected to pin 8 of the microprocessor 46 via a diode 74 and a resistor 72. And the data connection 55 can be electrically connected to pin 3 of the microprocessor 46 via resistor 58. Pin 4 acts as a ground reference for the microcontroller 46 and can be electrically grounded as is known in the art. The ground reference (in this case Pin 4) can also be connected to a ground terminal lead 47, which electrically communicates with the microcontroller 46. While the powering connection 53, the data connection 55, and the ground terminal lead 47 are shown in FIG. 2 as being isolated from each other, these elements may be included separately in a single physical connector capable of ultimately communicating with a computing device, such as an external personal computer (not shown). In one example, the powering connection 53, the data connection 55, and the ground terminal lead 47 can be grouped together as part of the kill switch terminal 44. The powering connection 53 and the data connection 55 of the kill switch terminal 44 can be coupled to an intermediary computing device that will communicate with a computer, such as the external PC, via a variety of connections that include universal serial bus (USB) ports or other parallel or serial ports that are known. This will be discussed in more detail below.

In one implementation, the kill switch terminal 44 can include a kill switch having a first function (to permit the stoppage of engine operation during normal use) and a second function (to permit the acquisition of data from the microcontroller 46). For example, the kill switch can be a momentary switch that is biased in the open position permitting a user to engage the switch and stop engine operation. Here, the kill switch can be electrically coupled to the powering connection 53, the data connection 55, and the ground terminal lead 47. It is also possible that the kill switch includes a plurality of positions, such as "OFF" and "ON." In this case, each of the plurality of positions can be selected using a rotating member, such as a key. While certain embodiments are described wherein data acquisition is accomplished by way of a kill switch, any other switch Or terminal coupled to the microcontroller 46 may be used. In this way, an existing switch or terminal may become a kill switch or terminal in that the existing component may have a first function during normal use of the engine and a second function to permit data acquisition from the microcontroller 46. Additionally, a switch or terminal communicating with the microcontroller 46 may be provided, and such a switch or terminal may permit data acquisition to and/or from the controller as its only purpose. That is, the switch or terminal might not have any other use with regard to normal operation or shutting down of the engine.

Each of the first function of engine use and the second function of engine use can use a different electrical and/or physical configuration of kill switch terminal 44. For example, the kill switch terminal 44 can include the powering connection 53, the data connection 55, and the ground terminal lead 47. The powering connection 53 and the data connection 55 can each be attached to a blade-shaped terminal. This can be appreciated from FIG. 2, which depicts the blade-shaped terminal for the powering connection 53 as power connection blade 53*a* and the blade-shaped terminal for the data connection 55 as data connection blade 55*a*.

In some implementations, the circuit 40 can be imprinted on a printed circuit board (PCB) (not shown). And the powering connection blade 53*a* and the data connection blade 55*a* can be initially formed using a solid and/or unitary one-piece structure such that blades 53*a* and 55*a* are connected to each other electrically and physically. Both the powering connection blade 53*a* and the data connection blade 55*a* can be electrically and/or physically attached (via, solder, etc.) as a unitary structure (e.g., a single piece) to the powering connection 53 and the data connection 55 of the circuit 40 implemented on the PCB via connection points 53*b* and 55*b*. After the unitary powering connection blade 53*a* and the data, connection blade 55*a* have been attached (electrically and physically) to the PCB, the blades 53*a* and 55*a* can be physically/electrically separated by removing a frangible portion 57 that can link the blades 53*a* and 55*a* during assembly to the PCB. The powering connection blade 53*a* and the data connection blade 55*a* can each form a separate "male" terminal. Similarly, the ground terminal lead 47 can also be implemented as a "male" terminal at the kill switch terminal 44. In this configuration, the kill switch terminal 44 can also include the kill switch that uses three "female" receptacles for receiving the powering connection blade 53*a*, the data connection blade 55*a*, and the ground terminal lead 47.

Preferably, after the frangible portion 57 has been removed from the terminal 44 the outer perimeter or footprint of its two separate connector legs 53*a*, 55*a* collectively have an outer perimeter, width, and thickness which is substantially the same as a conventional spade terminal currently used only as a single engine connection to a conventional kill switch of a light duty engine. This permits utilization of the same conventional kill switch and at the same location as the conventional stop spade connecter terminal for the normal stopping of the operating engine function and when this kill switch is removed also permits the microprocessor powering and data transfer function to be performed through the intermediate device or interface to an external digital computer. This also facilitates the assembly of the terminal 44 to the PCB and routing its electrically conductive traces to both legs 53*a*, 55*a*. This also facilitates encapsulating the PCB in epoxy or other polymer to protect it and it is both easier and more cost effective to protect both the control module and the terminal 55. This also permits continued use during assembly to the PCB of the locating hole within the perimeter of the terminal.

In the first function (to permit the stoppage of engine operation during normal use), the female receptacles of the kill switch can receive the powering connection blade 53*a*, the data connection blade 55*a*, and the ground terminal lead 47 such that the switch is coupled to the powering connection blade 53*a*, the data connection blade 55*a*, and the ground terminal lead 47. While the kill switch is coupled to the powering connection blade 53*a*, the data connection blade 55*a*, and the ground terminal lead 47, the kill switch electrically connects to the powering connection 53, the data connection 55, and pin 3 of the microcontroller 46 via resistor 58 shown in FIG. 2. When a user closes the kill switch, the connections 53 and 55 are electrically coupled with the ground terminal lead 47 via connection 49 (depicted in FIG. 2 by a dotted line) to stop normal running of the engine.

During the second function (to permit the acquisition of data from the microcontroller 46), the kill switch can be physically separated or disconnected from the kill switch terminal 44 such that the powering connection blade 53*a*, the data connection blade 55*a*, and the ground terminal lead 47 are no longer received by or in electrical contact with the multipurpose switch. The powering connection blade 53*a*, the data connection blade 55*a*, and the ground terminal lead 47 are then exposed and can then be used for data gathering, which will be discussed below in more detail.

Figure 3:
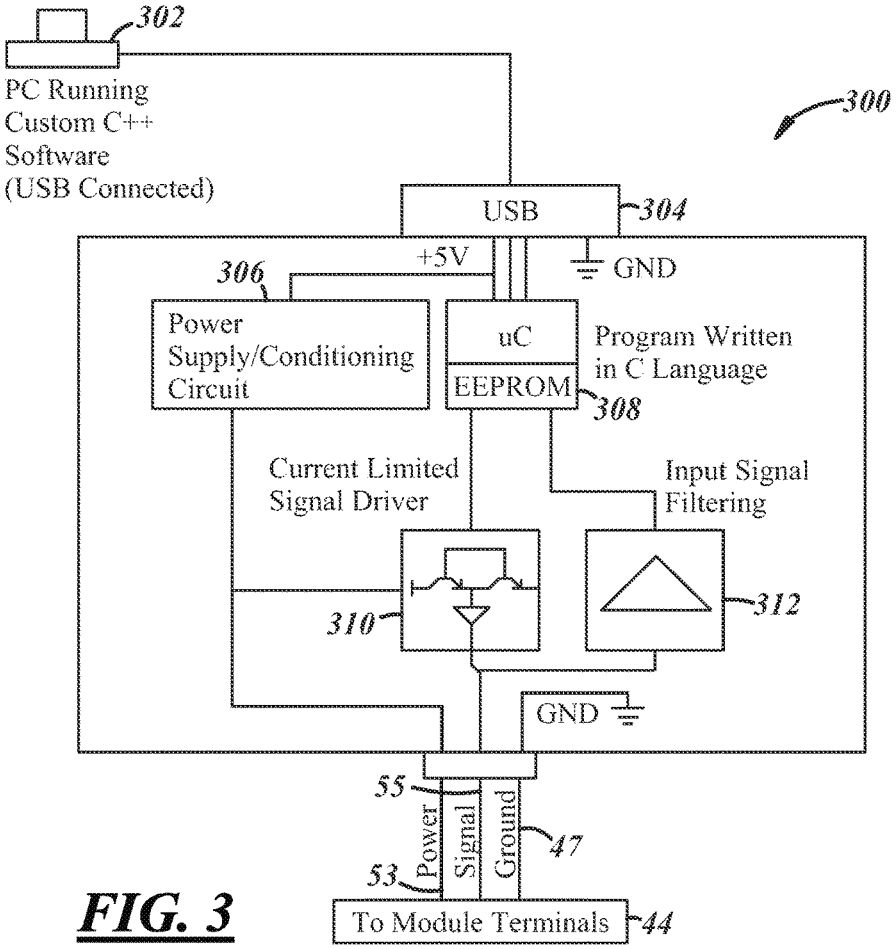
FIG. 3 is a block diagram of an embodiment of an intermediary computing device used to access engine operating data.

Turning to FIG. 3, a block diagram of an intermediary computing device 300 is shown. The intermediary computing device 300 can be an electrical device that is coupled to the microprocessor 46 via the powering connection 53, the data connection 55, and the ground terminal lead 47 of the circuit 40 shown in FIG. 2. Along with being coupled with the powering connection 53, the data connection 55, and the ground terminal lead 47, the intermediary computing device 300 can also be coupled to a PC 302. In one implementation, the intermediary computing device 300 can include a plug having three "female" receptacles for receiving "male" terminals of the powering connection 53, the data connection 55, and the ground terminal lead 47. An example of this plug is discussed in more detail below with respect to FIG. 4. The multi-function switch (not shown) can be separated from the kill switch terminal 44 of FIG. 2 to reveal the male terminals of the powering connection blade 53*a*, the data connection blade 55*a*, and the ground terminal lead 47 and the plug can be fitted such that the three female receptacles become physically and/or electrically connected to the powering connection blade 53*a*, the data connection blade 55*a*, and the ground terminal lead 47. The intermediary computing device 300 can also be coupled to the PC 302 via a port 304. The port 304 will be described with respect to FIG. 3 as a universal serial bus (USB) port. However, it should be appreciated that other types of serial ports used with PCs are known to those skilled in the art can be used with the system described herein.

The intermediary computing device 300 can also include a power supply conditioning circuit 306, an intermediary microprocessor 308, a current-limited signal driver 310, and input signal filtering 312. When the intermediary computing device 300 is coupled to both the circuit 40 (via the powering connection 53, the data connection 55, and the ground terminal lead 47) and the PC 302, the device 300 can use the power supply conditioning circuit 306 to power the microprocessor 46 (shown in FIG. 2). In one implementation, the power supply conditioning circuit 306 can communicate voltage from the PC 302 to the microprocessor 46 via the port 304 and powering connection 53. The power supply conditioning circuit 306 can be configured to regulate the voltage received from the PC 302 to an amount accepted by the microprocessor 46. It is also possible for the power supply conditioning circuit to receive power from a source external to the intermediary computing device 300, such as an AC power outlet, and convert that power to a DC voltage usable by the microprocessor 46. The power supply conditioning circuit 306 can also be coupled to the current-limited signal driver 310, which can act as a current limiter for data sent from the intermediary computing device 300 to the microprocessor 46 via the data connection 55.

After the microprocessor 46 has been powered up via the powering connection 53 using the power supply conditioning circuit 306, the intermediary microprocessor 308 of the intermediary computing device 300 can access computer code for directing the microprocessor 46 to send data via the data connection 55. The computer code can be implemented in a variety of computer languages known to those skilled in the art, such as "C++," and stored in an EEPROM accessible by the intermediary microprocessor 308. To send data to or access data from microprocessor 46, the intermediary microprocessor 308 can transmit a command via the current limited signal driver 310 and the data connection 55 that is readable by the microprocessor 46. After the microprocessor 46 receives the command from the intermediary microprocessor 308, the microprocessor 46 acts on the command and sends stored data to the intermediary computing device 300 via the data connection 55 or prepares to receive additional data from the device 300 via the connection 55. The intermediary computing device 300 can receive data from the processor 46 and pass it through the input signal filtering block 312 to the intermediary microprocessor 308. The intermediary microprocessor 308 can then send the received data to the PC 302 via the port 304. The system can be designed such that when the powering connection 53 and the data connection 55 are electrically connected together, the data connection 55 may be unable to communicate data because more current will be required to power the microprocessor 46 than will be available. This can ensure the separate use of the powering connection 53 and the data connection during data transfer. For instance, the current limited signal driver 310 can restrict current such that when current flows through both the powering connection 53 and the data connection 55 when they are electrically connected together the microcontroller 46 will not receive enough power to carry out data transfer. In one implementation, the current limited signal driver 310 can limit current to values ≤1.0 milliamps (mA). Thus, when the powering connection 53 and/or the data connection 55 are electrically connected together, current amounts used to obtain data cannot be obtained.

Once the PC 302 receives the data, the PC 302 can read the data using a software program suitable for reading such data. Much like the software used by the intermediary microprocessor 308, the software used by the PC 302 to read the data from the microprocessor 46 can be created in a variety of computer languages known to those skilled in the art, such as "C++." While the microcontroller 46 is powered via powering connection 53, the data connection 55 can bi-directionally communicate data from pin 3 of the microcontroller 46 through intermediary computing device 300 to an outside source, such as the PC 302. This exchange of data can include obtaining stored engine data from the microcontroller 46 or reprogramming or re-flashing the memory of the microcontroller 46.

Figure 4:
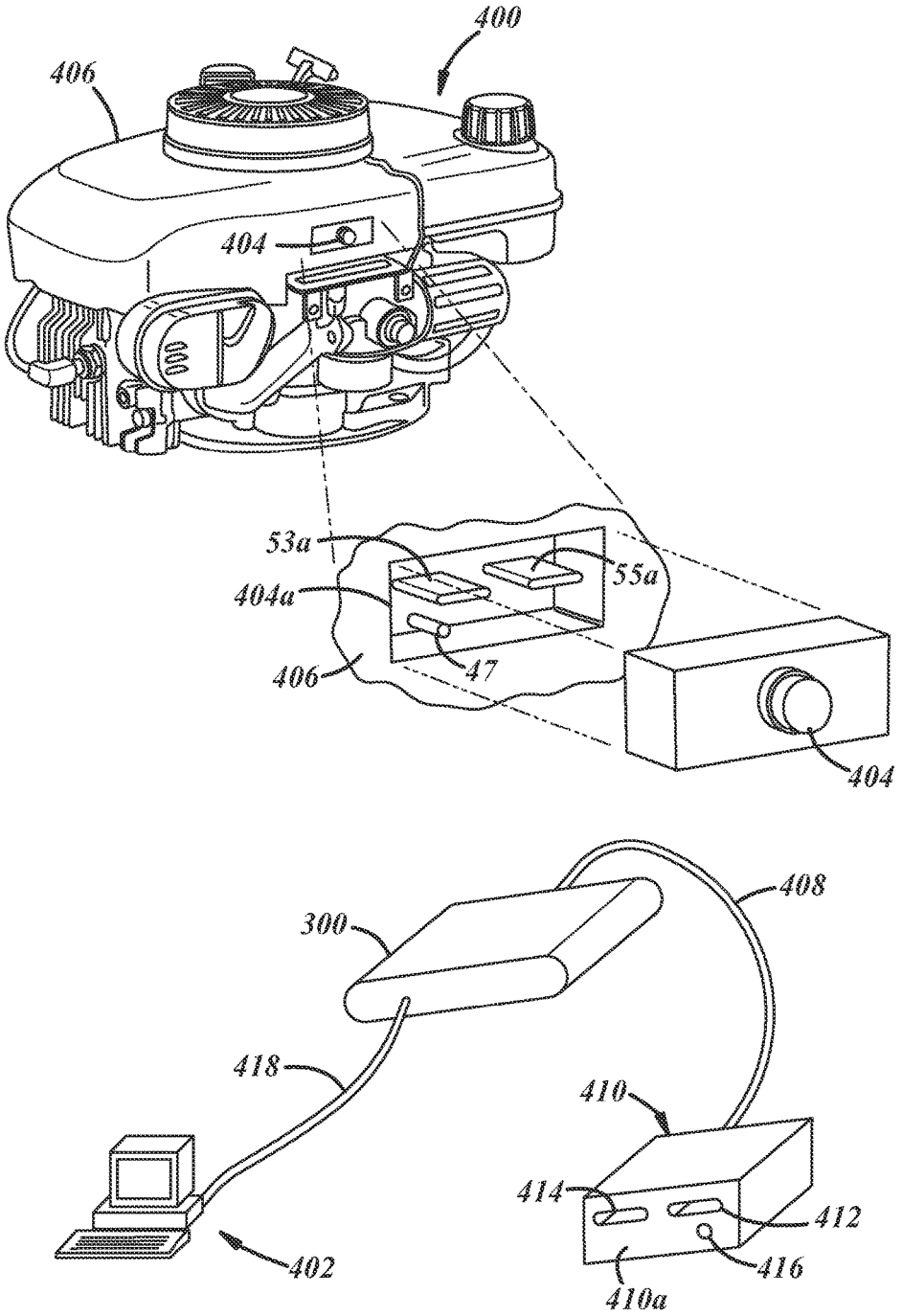
FIG. 4 is a block diagram of an engine, an intermediary computing device, and an external personal computer (PC)

Turning to FIG. 4, a block diagram depicts one embodiment of a light-duty engine 400 that can be used with the diagnostic data system described herein. The light-duty engine 400 is shown along with the intermediary computing device 300 and an external PC 402 that have been described in more detail above. A kill switch 404 is shown located on the cowl or cover 406 of light-duty engine 400. The kill switch 404 is an example of the switch described above with respect to FIG. 2 as part of the kill switch terminal 44. As noted above, the kill switch 404 can have a first function (to permit the stoppage of engine operation during normal use) and a second function (to permit the acquisition or transmission of data from/to the microcontroller 46). The kill switch 404 can frictionally fit within an opening in the cover 406 of the light-duty engine 400 during the first function and the switch 404 can be physically removed from the cover 406 during the second function.

FIG. 4 depicts a switch-removed configuration 404*a* in which the multi-function switch 404 has been physically removed from the cover 406 during the second function. Such removal reveals the powering connection blade 53*a*, the data connection blade 55*a*, and the ground terminal 47 described above with respect to FIG. 2. The powering connection blade 53*a*, the data connection blade 55*a*, and the ground terminal 47 are shown in the switch-removed configuration 404*a* from a perspective view, which depicts an elongated blade structure for the powering connection blade 53*a* and the data connection blade 55*a* whereas the ground terminal 47 is shown as a pin or rod-like elongated member. The powering connection blade 53*a*, the data connection blade 55*a*, and the ground terminal 47 can be located wholly within the cover 406 and yet remain accessible from outside the cover 406 via the switch-removed configuration 404*a*.

When the switch-removed configuration 404*a* reveals the powering connection blade 53*a*, the data connection blade 55*a*, and the ground terminal 47, the intermediary computing device 300 can be connected to the powering connection blade 53*a*, the data connection blade 55*a*, and the ground terminal 47 via a wire 408 that is terminated with a plug 410. The surface of the plug 410 that is fitted to the powering connection blade 53*a*, the data connection blade 55*a*, and the ground terminal 47 on or through the switch-removed configuration 404*a* is shown in more detail at 410*a*. The plug surface 410*a* includes individual and separate female receptacles for each of the powering connection blade 53*a*, the data connection blade 55*a*, and the ground terminal 47. These elongated female receptacles are shown on surface 410*a* in a perspective view as a first female receptacle 412 and a second female receptacle 414. A third female receptacle 416 is also shown in a perspective view on the surface 410*a* as a circular female receptacle for receiving the pin ground terminal 47. Once the plug 410 is mated with the powering connection blade 53*a*, the data connection blade 55*a*, and the ground terminal 47 via the switch-removed configuration 404*a*, data communication can commence between the PC 402 and the microcontroller 46 (shown in FIG. 2) via a USB cable 418, the intermediary computing device 300, the wire 408, and the plug 410 using the powering connection blade 53*a*, the data connection blade 55*a*, and the ground terminal 47. When data transfer is complete, the plug 410 can be physically removed and disconnected from the powering connection blade 53*a*, the data connection blade 55*a*, and the pin ground terminal 47. The kill switch 404 can then be returned to the cover 406 and frictionally fit into a position where it carries out its first function.

Figure 5:
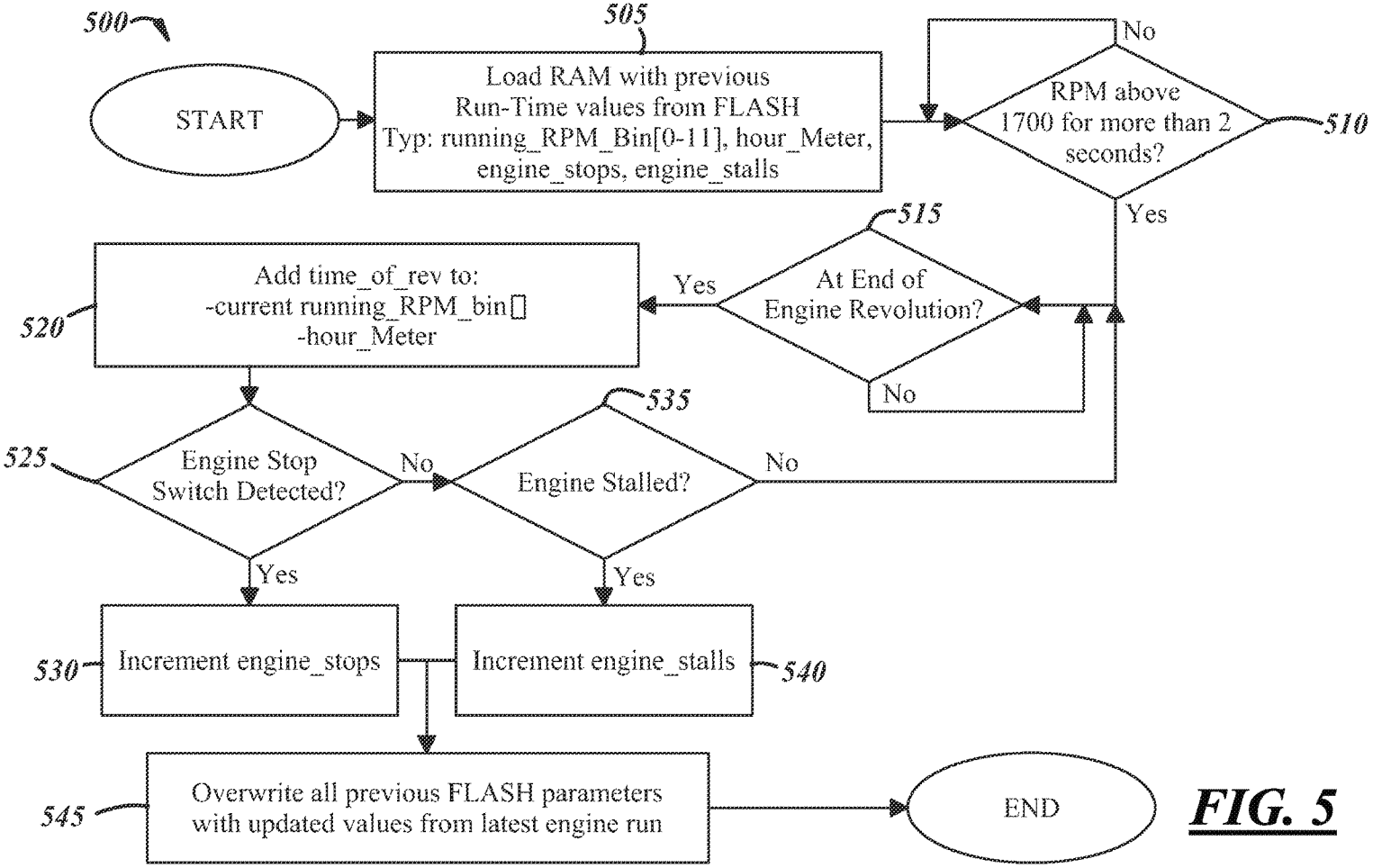
FIG. 5 is a flow chart of an embodiment of a method that can be used to record engine operating data.

Turning to FIG. 5, an exemplary method 500 for recording engine data is shown. Method 500 will be described with reference to devices described with respect to FIGS. 1-2. The method 500 begins at step 505 by accessing the memory of the microcontroller 46 to obtain previous engine data (if any) and loading that data onto the random access memory (RAM) of the microcontroller 46. This can be triggered by an engine operator attempting to start a light-duty engine, such as would occur when the engine operator began pulling a starter cord to turn the flywheel 12. Engine data can include any one or more data categories, including but not limited to time of engine operation within one or more ranges of revolutions-per-minute (RPM), number of engine starts, number of engine kills, number of engine stalls, and total hours/minutes of engine operation, to name a few. The method 500 then proceeds to step 510 to determine if the engine is running. A number of ways exist to establish this status. For example, if the microcontroller 46 determines that the engine is operating above 1700 RPM for more than 2 seconds, the method 500 can proceed to step 515. Otherwise, the method 500 repeats step 510.

At step 515, it is determined whether an engine revolution of the engine crankshaft has been completed. This can be established by detecting the electrical pulses that are generated by pole shoes 16, 18, and/or permanent magnet 17 when they induce a magnetic flux in the nearby stator assembly 14. The microcontroller 46 can then detect the presence of these pulses within a certain time period and determine a beginning of the engine revolution and an end of the engine revolution. If the microcontroller 46 detects the end of the engine revolution, then the method 500 proceeds to step 520. Otherwise, the method 500 repeats step 515.

At step 520, the occurrence of one or more engine revolutions and the time it takes to occur is recorded. This can be done by the microcontroller 46. In one example, this can be carried out by detecting the amount of time that has passed since the last engine revolution. Using the time that has passed between successive engine revolutions can indicate the speed of rotation of the engine crankshaft which can be used to determine the RPM of the engine. In one example, the microcontroller 46 can calculate the amount of time that has passed between successive engine revolutions. The microcontroller 46 can then access a lookup table stored in the memory of the microcontroller 46 that includes a number of categories. Each category can include a time range that is associated with an engine RPM range. When the microcontroller 46 determines that the time that has passed between successive engine revolutions falls within the time or RPM range of a particular category, a value associated with that category is incremented. For instance, if the microcontroller 46 accesses the lookup table and determines that the amount of time that has passed indicates that the engine is operating at 5200 RPM, the microcontroller 46 increments the value of a category associated with the engine running between 5000-6000 RPM. A plurality of categories can be maintained at the microcontroller 46. For instance, categories can be maintained for a large RPM range, such as between 2,000-11,000 RPM, and the categories can be delineated by various increments, such as 500 RPM, 1000 RPM, or both. The microcontroller 46 can maintain/store data representing the cumulative number of engine revolutions occurring, as well as any other engine data, over the life of the engine. This data is one example of engine data. As subsequent engine revolutions are recorded, those engine revolutions are added to previously-recorded engine revolutions and the number and/or rate of RPM over a period of time can be calculated based on this comparison. That is, in one example, RPM can be determined by the number of revolutions the microcontroller 46 detects during a minute of time. As the engine operates, RPM can be recorded during the time the engine operates and can be stored on the microcontroller 46. The method 500 then proceeds to step 525.

At step 525, it is determined if the engine has stopped. In one example, this can involve the microcontroller 46 detecting the activation of the kill switch terminal 44. If it is determined that the engine has stopped via the kill switch 44, the method 500 proceeds to step 530. Otherwise, the method 500 then proceeds to step 535.

At step 530, the number of engine stops is incremented. In one example, this can involve the microcontroller 46 accessing a previously stored number of engine stops that was loaded from the memory of the microcontroller 46 onto the RAM and adding one more to that value. The microcontroller 46 can maintain/store data representing the cumulative number of engine stops occurring over the life of the engine. When the microcontroller 46 detects an engine stop, the recorded number of engine stops can be incremented. The method 500 then proceeds to step 545.

If it has not been determined that the engine stopped at step 525, it is determined if the engine has stalled at step 535. In one example, an engine stall can be determined by the microcontroller 46 when it detects an absence of pulses generated by the pole shoes 16, 18 and/or no magnetic flux in the nearby stator assembly 14 coupled with an absence of kill switch terminal 44 activation. If an engine stall is detected, then the method 500 then proceeds to step 540. Otherwise, the method 500 proceeds to step 515 and continues to record engine data.

At step 540, the number of engine stalls is incremented. In one example, this can involve the microcontroller 46 accessing a previously stored number of engine stalls that was loaded onto the RAM and adding one more to that value. The microcontroller 46 can maintain/store data representing the cumulative number of engine stalls occurring over the life of the engine. When the microcontroller 46 detects an engine stall, the recorded number of engine stalls can be incremented. The method 500 then proceeds to step 545.

At step 545 the previously-stored values of engine data are overwritten with newly recorded data. This can take place when the engine has either stopped or stalled, in one example, the microcontroller 46 accesses the data that has been stored on the RAM while the engine is running and writes it onto its memory, such as flash memory, carried by the microcontroller 46. This can mean that the engine data obtained during steps 520, 530, and/or 540 is added to previously-gathered engine data and recorded for later access. In other words, the engine data gathered in method 500 is cumulative, such that the data obtained during the most recent engine use is added to previous engine operation. The method 500 then ends.

It of course be understood that the foregoing description is of preferred exemplary embodiments of the invention and that the invention is not limited to the specific embodiments shown. Various changes and modifications will become apparent to those skilled in the art and all such variations and modifications are intended to come within the spirit and scope of the appended claims.

The invention claimed is:

1. A spark ignition engine system for communicating data, the system comprising:

a capacitive discharge ignition having an ignition capacitor, a charge winding coupled to the ignition capacitor to provide a charge to the ignition capacitor, an electronic ignition switch coupled to the ignition capacitor to control discharging of the ignition capacitor, and a microcontroller connected to and providing a trigger signal to the electronic ignition switch to discharge the ignition capacitor whereupon the energy discharged from the ignition capacitor causes spark ignition in a gasoline-powered and spark-ignited internal combustion engine having no battery powering the microcontroller;

a kill switch accessible exteriorly of the internal combustion engine, coupled to the capacitive discharge ignition and actuated to selectively terminate operation of the internal combustion engine;

the microcontroller having a power pin receiving electric power powering the microcontroller and a separate data pin receiving or transmitting data or software;

an electronic memory device connected with the microcontroller, wherein the microcontroller obtains engine data from the operating internal combustion engine and stores the engine data or software in the memory device;

a power connector accessible from the exterior of the engine and electrically connected to the power pin of the microntroller and a separate data connector accessible from the exterior of the engine and electrically connected to the charge coil and to the data pin of the microcontroller, and the power connector supplies power to the microcontroller at least while engine data or software is communicated to or from the memory device and a personal computer external of the engine via the separate data connector while the engine is not operating; and to terminate normal engine operation the kill switch connects both the power connector and the separate data connector to ground.

2. The spark ignition system of claim 1, further comprising an intermediary computing device external of the personal computer and the engine and that detachably connects with the power connector to power the microcontroller and the separate data connector to communicate data between the microcontroller and the personal computer, and the the intermediary computing device having an intermediary microcontroller detachably connecting with the data connector and the personal computer.

3. The spark ignition system of claim 1, further comprising one terminal, and wherein the power connector is a powering connection blade and the data connector is a separate data connection blade with only one power blade, and one data blade carried by such one terminal.

4. The spark ignition system of claim 3, wherein the powering connection blade and the data connection blade are initially formed as one piece but the powering connection blade and the data connection blade are later separated into separate blades of such terminal.

5. The spark ignition system of claim 4, wherein the powering connection blade and the data connection blade are separated by removing a frangible portion.

6. The spark ignition system of claim 1, wherein the powering connection and the separate data connection are accessed by removing a kill switch from a cover of the internal combustion engine.

7. A spark ignition engine system for communicating data, the system comprising:

a capacitive discharge ignition system having an ignition capacitor, a charge winding coupled to the ignition capacitor, an electronic ignition switch coupled to the ignition capacitor to control discharging of the ignition capacitor, and a microcontroller connected to and providing a trigger signal to the electronic ignition switch to discharge the ignition capacitor to control the ignition of a gasoline-powered and spark-ignited internal combustion engine;

a kill switch accessible exteriorly of the internal combustion engine, coupled to the capacitive discharge ignition and actuated to selectively terminate operation of the internal combustion engine;

the microcontroller having a power pin receiving electric power powering the microcontroller and a separate data pin receiving or transmitting data or software;

an electronic memory device connected with the microcontroller, wherein the microcontroller obtains engine data from the operating internal combustion engine and stores the engine data or software in the memory device;

a data connector accessible from the exterior of the engine and electrically connected to the charge coil and to the data pin of the microcontroller;

a separate power connector accessible from the exterior of the engine and electrically connected to the charge coil and to the power pin of the microcontroller and while the engine is not operating powering the microcontroller at least while engine data or software is communicated via the data connector;

to terminate normal engine operation the kill switch connects both the separate power connector and the data connector to the ground; and an intermediary computing device external of the engine, having an intermediary microncontroller and detachably connected to the data connector and the separate power connector while engine data or software is communicated via the data connector while the engine is not operating, and wherein the intermediary computing device supplies power to the microcontroller via the separate power connector while the engine is not operating.

8. The spark ignition system of claim 7, which also comprises one terminal and wherein the power connector is a powering connection blade and the data connector is a separate data connection blade with only one power blade and only one data blade in such one terminal.

9. The spark ignition system of claim 8, wherein the powering connection blade and the data connection blade are initially formed as one piece but the powering connection blade and the data connection blade are later separated into separate terminals.

10. The spark ignition system of claim 9, wherein the powering connection blade and the data connection blade are separated by removing a frangible portion.

11. The spark ignition system of claim 7, wherein the power connector blade and the separate data connector blade are accessed by removing a kill switch from a cover of the internal combustion engine.

12. A spark ignition engine system for communicating data, the system comprising:

a capacitive discharge ignition system having an ignition capacitor, a charge winding coupled to the ignition capacitor, an electronic ignition switch coupled to the ignition capacitor to control discharging of the ignition capacitor, and a microcontroller connected to and providing a trigger signal to the electronic ignition switch to discharge the ignition capacitor to control the ignition of a gasoline-powered and spark-ignited internal combustion engine;

an electronic memory device electrically connected with the microcontroller, wherein the microcontroller obtains engine data from the internal combustion engine and stores the engine data or software in the memory device; and a kill switch that is removably-carried by a cover of the internal combustion engine, wherein the kill switch is electrically connected with a data connector electrically connected to the charge coil and to the microcontroller and with a separate power connector electrically connected to the microcontroller to power the microcontroller when the engine is not running; and when the kill switch is removed and disconnected from the data connector and the separate power connector, an intermediary computing device external to the engine is connected to the data connector to communicate data or software with the microcontroller and the intermediary computing device is connected to the power connector to supply power to the microcontroller while the engine is not operating.

* * * * *